United States Patent [19]

Cheng

[11] Patent Number: 4,656,064

[45] Date of Patent: Apr. 7, 1987

[54] DECORATIVE BOW-FORMING RIBBON ASSEMBLY

[76] Inventor: Peter S. C. Cheng, 5 Ross St., Toronto, Ontario, Canada, M5T 1Z8

[21] Appl. No.: 879,569

[22] Filed: Jun. 27, 1986

[51] Int. Cl.[4] ..... D04D 7/10

[52] U.S. Cl. ..... 428/4; 223/46; 428/101; 428/131

[58] Field of Search ..... 428/4, 5, 24, 25, 26, 428/101, 131, 136; 223/46

[56] References Cited

U.S. PATENT DOCUMENTS

| | | | |
|---|---|---|---|
| 2,826,225 | 3/1958 | Hagenbuch | 428/5 X |
| 2,841,905 | 7/1958 | Wanchek | 428/5 |
| 2,845,736 | 8/1958 | Crawford | 428/5 |
| 2,849,821 | 9/1958 | Doig | 428/5 |
| 3,010,236 | 11/1961 | Doig | 428/5 |
| 3,030,719 | 4/1962 | Enomoto | 428/5 X |
| 3,479,243 | 11/1969 | Doig | 428/5 |
| 3,632,464 | 1/1972 | Grikis | 428/4 |
| 3,637,455 | 1/1972 | Pearson et al. | 428/4 |
| 3,954,212 | 5/1976 | Bolis | 428/4 X |
| 4,329,382 | 5/1982 | Truskolaski et al. | 428/4 |
| 4,449,652 | 5/1984 | Coppins et al. | 428/4 X |
| 4,476,168 | 10/1984 | Aoyama | 428/4 |
| 4,515,837 | 5/1985 | Cheng | 428/4 |
| 4,585,676 | 4/1986 | De Smet et al. | 428/26 X |

FOREIGN PATENT DOCUMENTS

| | | | |
|---|---|---|---|
| 1200982 | 7/1959 | France | 428/5 |

*Primary Examiner*—Henry F. Epstein

*Attorney, Agent, or Firm*—Kirschstein, Kirschstein, Ottinger & Israel

[57] ABSTRACT

A bow-forming ribbon assembly has a decorative flexible ribbon and a drawstring connected loosely to, and freely guided through pairs of apertures formed in, the ribbon lengthwise thereof. Between each pair of apertures, a bending zone is provided which extends at an angle of inclination, which angle is different and of opposite slope from that of the adjacent preceding inclination angle. During forming of the bow, the drawstring bends the ribbon across each bending zone, and forms bow loops distributed at various angles around the axis of the bow to form a pompon-like shape.

10 Claims, 13 Drawing Figures

FIG. 4
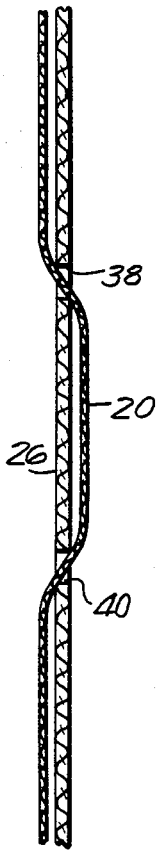
FIG. 5
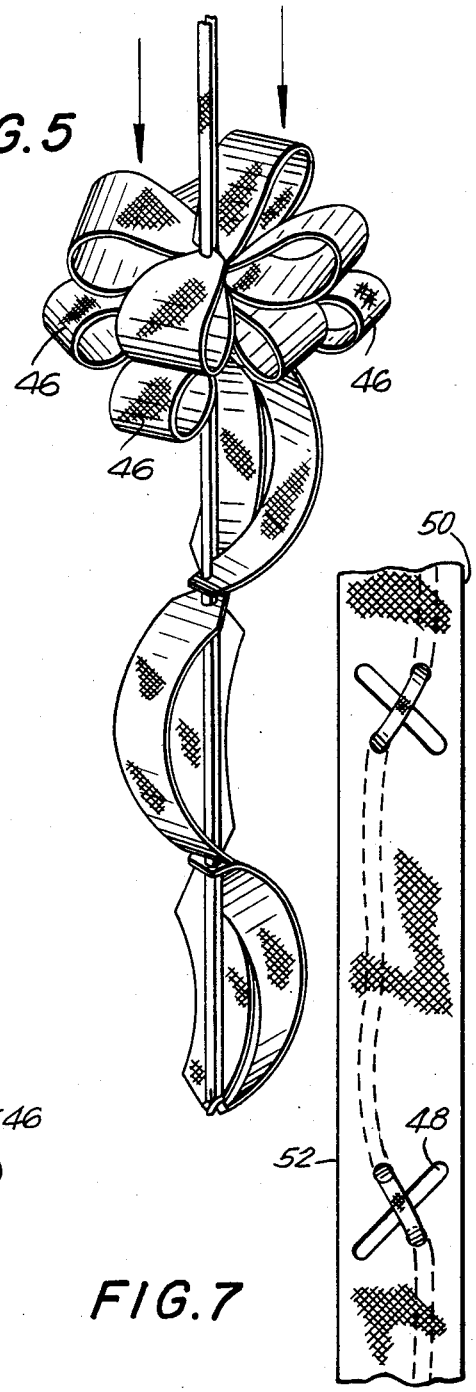
FIG. 6
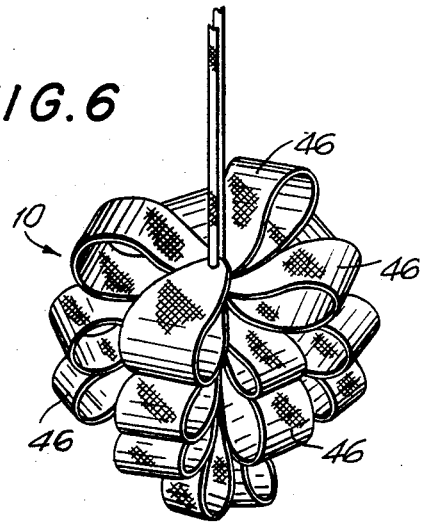
FIG. 7

DECORATIVE BOW-FORMING RIBBON ASSEMBLY

BACKGROUND OF THE INVENTION

1. Field of the Invention

The present invention relates to a ribbon assembly for forming a decorative bow of the type applied to wrapped gifts for decorative purposes.

2. Description of the Prior Art

It was known in the art to provide a decorative ribbon with a drawstring connected loosely to the ribbon at points along its length. The drawstring was secured to the ribbon at one end so that a user of the ribbon could draw the ribbon into a number of arcuate loops by pulling on the drawstring. This arrangement was advantageous because the ribbon could be packed flat, thus greatly facilitating and reducing the costs of storage and transport of the ribbon-drawstring assemblies, as compared with pre-formed bows which were relatively bulky and needed to be packed in crush-proof containers.

However, the known assemblies suffered from the disadvantage that, on pulling the drawstring, the ribbon tended to fold itself into loops which were all aligned in one vertical plane, thus forming a fan shape. This was inconvenient to the user who normally desired the bow to be arranged in a more decorative rosette or pompon form. This also necessitated the user having to pull on the individual loops to rotate them laterally and rearrange them so that the loops were spaced angularly around a central axis of the bow. Apart from being time-consuming, this manipulation presented the risk of the bow becoming torn, damaged and soiled.

In an attempt to overcome such disadvantages, I proposed, in my previous U.S. Pat. No. 4,515,837, a bow-forming ribbon which comprised a decorative, flexible ribbon, a plurality of relatively stiff retainers or clips spaced apart lengthwise of the ribbon and oriented generally transversely across the ribbon at different angles with respect to the transverse direction, and a drawstring running freely through the successive inclined clips alongside the ribbon.

As the bow of my previous patent was being formed by pulling on the drawstring, each clip tended to seat itself on the bow loop that was being formed immediately adjacent thereto in an angularly skewed orientation relative to the latter, and tended to skew each loop of the bow relative to the loop beneath, so that the loops of the bow were arranged in angularly-spaced rosette or pompon-like form. Each clip was inclined at an angle opposite to that of the preceding clip.

Although generally satisfactory for its intended purpose, experience has shown that my previously patented bow was disadvantageous in that it was costly to manufacture and assemble. It required multiple clips to be made, positioned on the ribbon and, of course, the drawstring had to be routed successively through each clip. This involved a great deal of extra cost, both in manufacture and assembly.

Other patents of which I am aware include U.S. Pat. Nos. 2,841,905; 2,845,736; 2,849,821; 3,010,236; 3,030,719; 3,632,464; 3,637,455; 3,954,212; 4,329,382; 4,449,652 and 4,476,168; and French Patent No. 1,200,982.

SUMMARY OF THE INVENTION

1. Objects of the Invention,

Accordingly, it is a general object of this invention to overcome the drawbacks of the prior art bow-forming ribbon assemblies.

It is another object of this invention to provide a lower labor- and cost-intensive ribbon assembly.

It is a further object of this invention to provide a decorative bow which can be packed conveniently in flat form, which can be formed conveniently at the point of use, and which requires no components other than the drawstring and ribbon themselves.

2. Features of the Invention

In keeping with these objects, and others which will become apparent hereinafter, one feature of this invention resides, briefly stated, in a bow-forming ribbon assembly which comprises a longitudinally-extending, decorative, flexible ribbon having a central longitudinal axis, and opposite end regions. A plurality of bending zones are spaced apart from each other at intervals lengthwise of the ribbon. These bending zones extend along bending axes generally transversely across the ribbon at angles of inclination relative to the central axis. Each inclination angle is different and of opposite slope from that of the adjacent preceding inclination angle.

In further accordance with this invention, a plurality of pairs of apertures, one pair for each bending zone, are arranged at intervals lengthwise of the ribbon. Each aperture pair has one aperture at one side of a respective bending zone, and offset along a transverse direction perpendicular to the longitudinal axis, and another aperture at an opposite side of the respective bending zone and offset along an opposite transverse direction perpendicular to the longitudinal axis.

A longitudinally-extending drawstring is connected to one end region of the ribbon, and is pullable toward the other end region of the ribbon during forming of a bow. The drawstring runs freely through the apertures, and extends in a generally perpendicular direction between each pair of apertures across each bending zone. Thus, during forming of the bow, i.e. when a user pulls the drawstring, the ribbon is bent about each bending axis. The different and oppositely sloped inclination angles of each bending zone ensures that the bow loops that are being formed are arranged in angularly-spaced rosette or pompon-like form relative to a central axis of the finished bow.

It is advantageous if the ribbon is folded about a transverse fold axis to form two ribbon members in face-to-face relationship. The drawstring is advantageously situated between the ribbon members over most of the length of the drawstring, and is situated exteriorly of the ribbon members over the remaining length of the drawstring, and particularly in those regions where the drawstring extends between each pair of apertures across each bending zone. It is further advantageous if the drawstring is folded to form two drawstring members, one drawstring member for each ribbon member. Each drawstring member runs freely through the apertures arranged lengthwise of a respective ribbon member.

In accordance with one embodiment of this invention, the pairs of apertures on one of the ribbon members are in alignment with the pairs of apertures on the other of the ribbon members. Each drawstring member is sequentially routed only through the pairs of apertures on the ribbon member associated with the respective drawstring member.

In accordance with a second embodiment of this invention, the pairs of apertures on one of the ribbon members are longitudinally displaced from the pairs of apertures on the other of the ribbon members. The drawstring members are sequentially routed from one pair of apertures on said other ribbon member to the displaced pair of apertures on said one ribbon member before being returned to the next pair of apertures on said other ribbon member.

In accordance with a third embodiment of this invention, the pairs of apertures on said one and said other ribbon members are in alignment with each other, and the drawstring members are sequentially routed from one pair of apertures on said other ribbon member to the aligned pair of apertures on said one ribbon member before being returned to the next pair of apertures on said other ribbon member.

Yet another important aspect of this invention resides in the formation of the bending zones. These bending zones may advantageously be formed by providing a plurality of pairs of notches extending inwardly from opposite edges of the ribbon. Each pair of notches bounds a neck of reduced width as compared to the width of the ribbon. Each neck is inclined along a respective bending axis.

Alternatively, the ribbon may be formed with a plurality of cutouts, each situated at, and elongated along, a respective bending axis. Each cutout may desirably be of elliptical contour.

Still another means for providing the bending zones on the ribbon is to form crease lines along the bending axes. Advantageously, these crease lines will be of a semi-permanent or permanent nature.

The apertures through which the drawstring extends may be of any contour and, in a preferred embodiment, each aperture is a circular hole.

The novel features which are considered as characteristic of the invention are set forth in particular in the appended claims. The invention itself, however, both as to its construction and its method of operation, together with additional objects and advantages thereof, best will be understood from the following description of specific embodiments when read in connection with the accompanying drawings.

BRIEF DESCRIPTION OF THE DRAWINGS

FIG. 4 is an enlarged sectional view taken on line 4—4 of FIG. 3;

FIG. 5 illustrates the procedure of forming the bow of FIG. 1;

FIG. 6 is a perspective view of the completed bow;

FIG. 7 is a view analogous to FIG. 1 of a second embodiment in accordance with this invention;

DETAILED DESCRIPTION OF THE PREFERRED EMBODIMENTS

Figure 1:
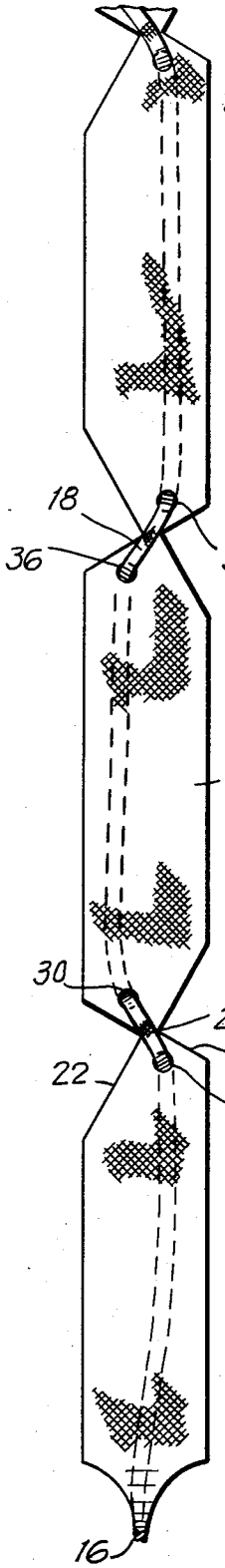
FIG. 1 is a partially broken-away front view of a first embodiment of a bow-forming ribbon assembly in accordance with this invention.
Figure 2:
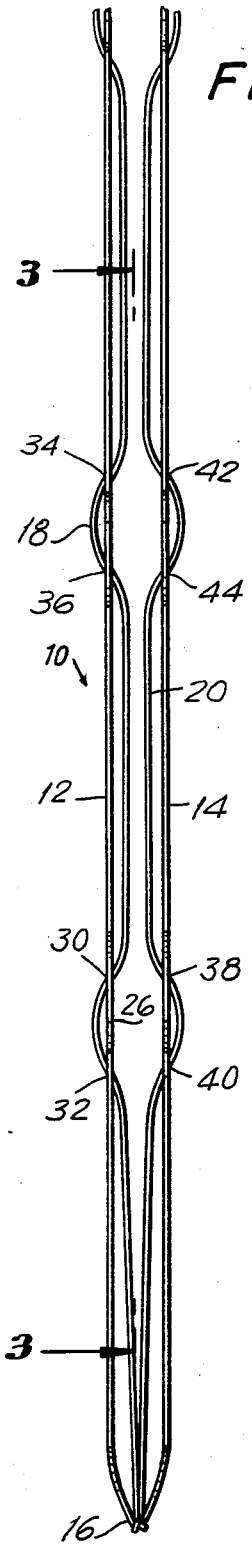
FIG. 2 is a side view of the assembly of FIG. 1.

Referring now to the drawings, FIGS. 1–5 show a first embodiment of a ribbon assembly 10 which is used to form the pompon bow illustrated in FIG. 6. The ribbon assembly 10 includes a single length of conventional decorative ribbon material, e.g. a conventional synthetic plastic having a satin-like fibrous texture, and folding the single ribbon at a middle portion 16 thereof to form two ribbon members 12, 14 disposed in face-to-face relationship, as best shown in FIG. 2.

The assembly 10 further includes a single length of a drawstring of a narrower width than that of the ribbon material. The drawstring is folded at a middle portion thereof to form two drawstring members 18, 20, one for each ribbon member, which is best shown in FIG. 2. The drawstring is tied in a knot at its middle portion to the middle portion 16 of the ribbon.

Although, in the first embodiment, the ribbon assembly 10 includes a folded-over single ribbon and a folded-over single drawstring, it will be appreciated that the ribbon may, instead, include two separate ribbon members or a single non-folded ribbon. It will be further appreciated that the drawstring may, instead, include two separate drawstring members, or one non-folded drawstring. In each case, it is merely necessary for the ribbon or the drawstring to be individually elongated, and to have one end of the drawstring secured to the ribbon at some point along the length thereof, and to have a loose end region of the drawstring unsecured to the ribbon so that a user may pull the loose end and draw the secured end toward the loose end, as diagramatically shown in FIG. 5, during forming of the bow.

Figure 3:
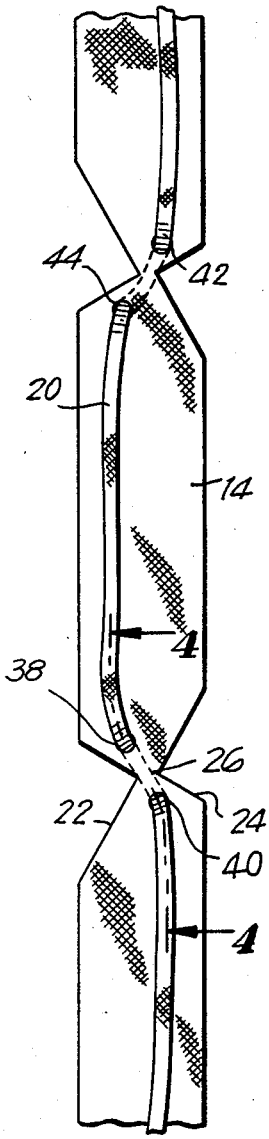
FIG. 3 is a sectional view taken on line 3—3 of FIG. 2.

As best seen in FIGS. 1 and 3, each ribbon member is formed into a series of segments, preferably of approximately uniform length, by a plurality of pairs of opposed asymmetrical, generally V-shaped notches 22, 24 cut from opposite side edges of the ribbon members. The notches 22, 24 of each pair are offset longitudinally from one another so that a narrow neck portion 26 is formed between each pair of notches. The neck portions 26 constitute bending or weakened zones spaced apart at intervals lengthwise of the ribbon members. The neck portions 26 are inclined, and extend along bending axes generally transversely across the ribbon at small angles of inclination, e.g. about 30° to about 40° with respect to a horizontal axis extending perpendicularly to a central longitudinal axis extending down the center of each of the ribbon members. The successive pairs of notches are formed so that each neck portion inclines at an angle of inclination different and of opposite slope from that of the preceding neck portion. Thus, a first neck portion may have a positive slope, a second neck portion may have a negative slope, the next neck portion may have a positive slope, and so on from one end of each ribbon member to the opposite end thereof.

The drawstring members 18, 20 are freely guided from their common secured end region at middle portion 16 to their loose end regions through a plurality of pairs of apertures formed at intervals lengthwise of each ribbon member. Each aperture pair is associated with a respective bending zone at neck region 26. Each aperture pair includes a pair of holes, preferably of circular outline, one hole being located at one side of a respective bending zone and offset along a transverse direction perpendicular to the central longitudinal axis of a respective ribbon member, and the other hole being located at an opposite side of the respective bending zone and offset along an opposite transverse direction perpendicular to the aforementioned central longitudinal axis.

As best shown in FIG. 1, a first pair of circular holes 30, 32 are formed in ribbon member 12, with hole 30 lying to the left of the central axis, and hole 32 lying to the right of the central axis. The next adjacent pair of circular holes 34, 36 formed on ribbon member 12 has hole 34 lying to the right of the central axis, and hole 36 lying to the left of the central axis. This pattern repeats itself for successive hole pairs along ribbon member 12.

The same pattern holds true for ribbon member 14, wherein a first pair of holes 38, 40 on ribbon member 14 is aligned with the aforementioned holes 30, 32 on ribbon member 12, and wherein a second pair of holes 42, 44 on ribbon member 14 is aligned with the aforementioned pair of holes 34, 36 on ribbon member 12 when the ribbon members 12, 14 are in face-to-face relationship.

In the embodiment of FIGS. 1–6, the drawstring members 18, 20 are routed through the pairs of holes in ribbon members 12, 14 in the following manner:

Starting with the knot at the middle portion 16, drawstring member 18 extends between the ribbon members 12, 14, and is guided through hole 32 to the exterior of ribbon member 12, whereupon the drawstring member 18 is again returned to an interior position between ribbon members 12, 14 through hole 30. Drawstring member 18 continues along the interior of ribbon members 12, 14 until it reaches the next pair of holes, whereupon it is routed exteriorly through hole 36 and again interiorly through hole 34. This in-and-out threading of drawstring member 18 through successive hole pairs is continued along the entire length of ribbon member 12. Analogously, the same in-and-out threading of the drawstring member 20 sequentially through holes 40, 38, 44 and 42 is continued along the entire length of ribbon member 14. As best shown in FIG. 2, the drawstring and ribbon members are mirror-symmetrically disposed about a vertical plane which lies parallel to the plane of ribbon members 12, 14, and which passes through the middle portion 16.

In use, the ribbon in the flat form depicted in FIGS. 1–4 is converted into a decorative rosette or pompon by grasping the loose free ends of the drawstring members 18, 20 in one hand, and by holding a portion of the ribbon members 12, 14 lightly between the fingers and thumb of the other hand. The drawstring members are then pulled so that the tied middle portion 16 of the ribbon is drawn toward the loose free ends of the ribbon members. During this process, as shown in FIG. 5, the segments of the ribbon members are gathered up into loops 46. Because of the angled orientations of the bending zones, the loops 46 are also formed at angularly-skewed orientations. Then the successive loops 46 tend to be skewed angularly relative to one another at differently sloped angles around the axes of the drawstring members 18, 20 so that, instead of the loops 46 tending to superimpose themselves one on the other, the successive loops are arranged at differing angles spaced circumferentially around the axes of the drawstring members to form the completed bow of FIG. 6.

Once the bow 10 is completed, the drawstring members may be knotted adjacent the underside of the complete bow, and the loose free ends of the drawstring members may be cut off. Alternatively, the drawstring members may be used for tying a parcel or gift package, and may thus secure the completed bow in position around the parcel or package to be decorated by the bow.

The bow-forming ribbon assembly may be provided to the user with an adhesive-backed card having an aperture through which the free ends of the drawstring members are threaded. The adhesive-backed card may normally be covered by a peelable release paper which is removed after forming of the bow in order to adhesively secure the bow to a parcel.

The bow-forming assembly may be packed flat for storage, transport, and display at the point of sale. The ribbon may, for example, be folded about the bending zones, with the segments of the ribbon members folded one atop another to provide a compact folded structure.

Turning now to the modification shown in FIG. 7, rather than forming each bending zone by a pair of opposed notches 22, 24 between which the neck portion 26 is formed, each bending zone may be formed by providing an elongated opening such as the elliptical slot 48 at an angle of inclination relative to the central axis of the ribbon. Each inclined slot 48 has an opposite slope compared to that of the adjacent preceding slot. Each slot extends transversely across, but terminates short of, the opposite longitudinal side edges 50, 52 of the ribbon. Each slot 48 weakens the ribbon by its very presence, and facilitates bending about an axis which extends along the inclination angle of the respective slot.

Figure 8:
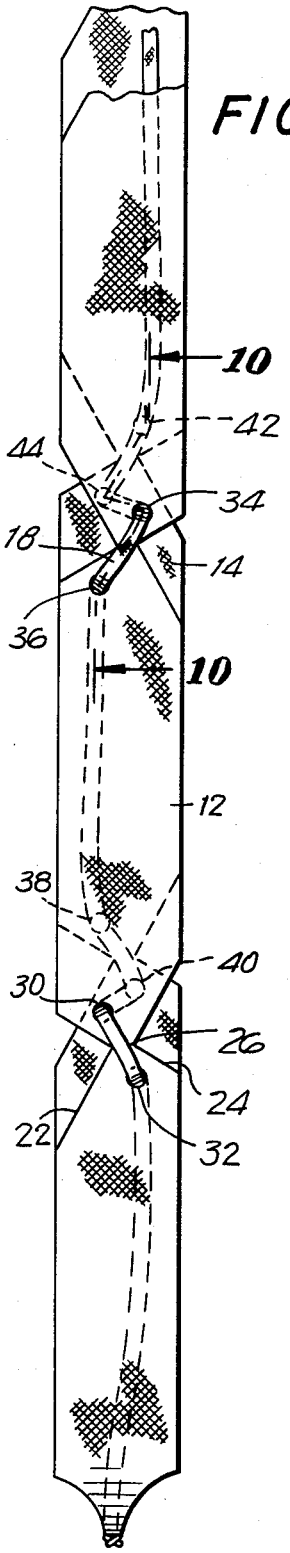
FIG. 8 is a view analogous to FIG. 1 of a third embodiment of this invention.
Figure 9:
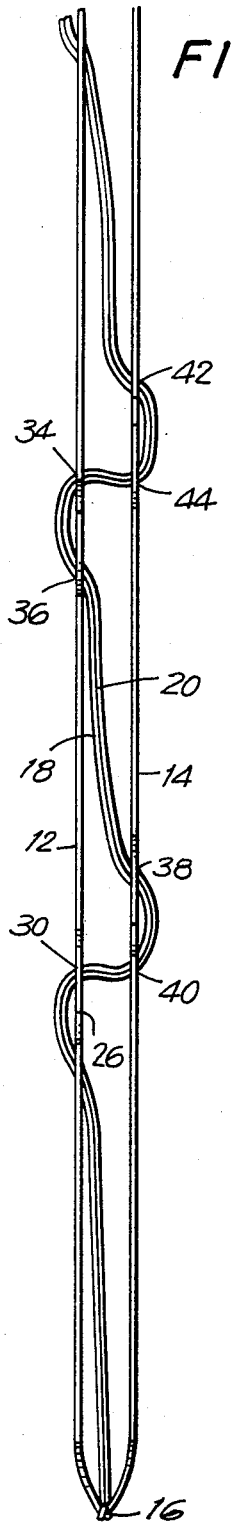
FIG. 9 is a view analogous to FIG. 2 of the third embodiment of FIG. 8.
Figure 10:
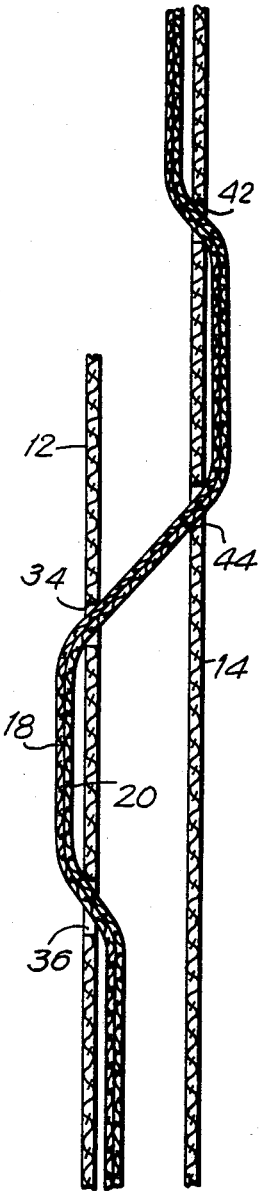
FIG. 10 is an enlarged sectional view taken on line 10—10 of FIG. 8.

Turning next to the embodiment of FIGS. 8–10, like reference numerals have been employed to those used earlier in connection with the embodiment of FIGS. 1–6. It will be noted that, in contradistinction to the FIGS. 1–6 embodiment, the pairs of apertures on ribbon member 12 are longitudinally displaced from the pairs of apertures on ribbon member 14 when the ribbon members are folded and are placed in face-to-face relationship. Thus, apertures 30, 32 are spaced downwardly from apertures 38, 40, and do not overlap each other as in the FIGS. 1–6 embodiment. The drawstring members 18, 20 are sequentially routed, not individually along a respective ribbon member, but in tandem from one ribbon member to the other.

Starting from the knot at middle portion 16 in FIG. 9, the drawstring members 18, 20 are extended between the ribbon members 12, 14, and are both guided through hole 32 to the exterior of ribbon member 12, whereupon both drawstring members are guided interiorly through hole 30 between the ribbon members. Thereupon, the drawstring members are virtually immediately routed through the hole 40 to the exterior of ribbon member 14, whereupon the drawstring members are again returned interiorly of the ribbon members through hole 38. The drawstring members continue along the interior of the ribbon members until they reach the next pair of holes on drawstring member 12, whereupon they are routed exteriorly through hole 36 and interiorly through hole 34. This in-and-out threading of the drawstring members is continued along the entire length of the drawstring members from one ribbon member to the next.

Figure 11:
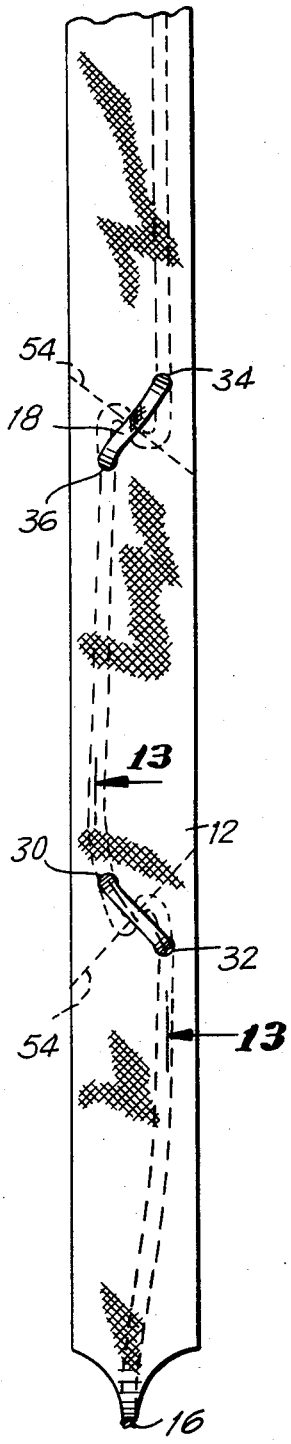
FIG. 11 is a view analogous to FIG. 1 of a fourth embodiment of this invention.
Figure 12:
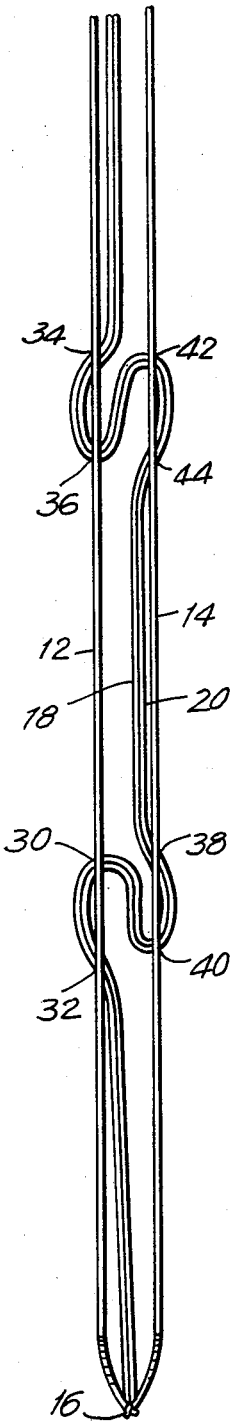
FIG. 12 is a view analogous to FIG. 2 of the fourth embodiment of this invention.
Figure 13:
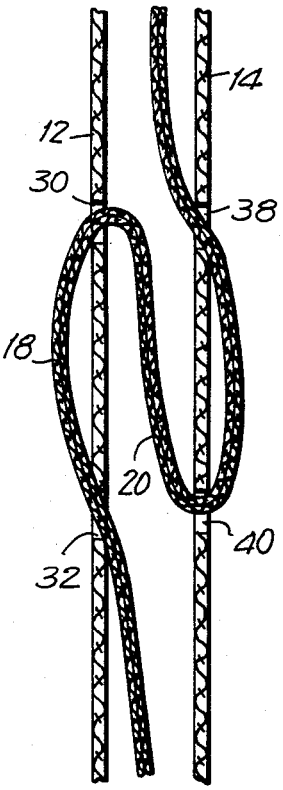
FIG. 13 is an enlarged sectional view taken on line 13—13 of FIG. 11.

Finally, like reference numerals have also been employed in the embodiment of FIGS. 11–13, wherein it will be noted that the pairs of apertures on ribbon member 12 are not longitudinally displaced from the pairs of apertures on ribbon member 14, but, instead, are aligned therewith when the ribbon members 12, 14 are positioned in face-to-face relationship. The tandem in-and-out threading of the drawstring members is identical to that described above in connection with the embodiment of FIGS. 8–10, and will not be repeated for the sake of brevity. No notches are provided on the ribbon members 12, 14 in the embodiment of FIGS. 11–13 and, instead, each bending zone between each pair of opposed holes is formed by inclined creases shown diagrammatically in dashed lines in FIG. 11. These creases 54 are either permanently or semi-permanently formed in the ribbon members, and constitute weakened or bending zones along which the ribbon is bent during forming of the bow.

It will be understood that each of the elements described above, or two or more together, also may find a useful application in other types of constructions differing from the types described above.

For example, rather than connecting the drawstring to one end region of the ribbon and pulling the drawstring in a direction toward the other end region of the ribbon, both ends of the drawstring can be loose. Then, to form a bow, both loose drawstring ends can be held in one's hand, and one can gather the ribbon toward the center. It is merely necessary for some relative movement to be conducted between the drawstring and the ribbon to form the bow.

While the invention has been illustrated and described as embodied in a decorative bow-forming ribbon assembly, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the following claims:

1. A bow-forming ribbon assembly, comprising:

(a) a longitudinally-extending decorative flexible ribbon having a central longitudinal axis;

(b) a plurality of bending zones spaced apart at intervals lengthwise of the ribbon, and extending along bending axes generally transversely across the ribbon at angles of inclination relative to the central axis, each inclination angle being different, and of opposite slope, from that of the adjacent preceding inclination angle;

(c) a plurality of pairs of apertures, one pair for each bending zone, arranged at intervals lengthwise of the ribbon, each pair having one aperture at one side of a respective bending zone and offset along a transverse direction perpendicular to the longitudinal axis, and another aperture at an opposite side of the respective bending zone and offset along an opposite transverse direction perpendicular to the longitudinal axis; and (d) a longitudinally-extending drawstring running freely through the apertures and extending in a generally perpendicular direction between each pair of apertures across each bending zone to bend the ribbon about each bending axis during forming of a bow.

2. The assembly as recited in claim 1, wherein the ribbon is folded about a transverse fold axis to form two ribbon members in face-to-face relationship; and wherein the drawstring is situated between the ribbon members over a major portion of the length of the drawstring, and is situated exteriorly of the ribbon members over a minor portion of the length of the drawstring as the drawstring extends between each pair of apertures across each bending zone.

3. The assembly as recited in claim 2, wherein the drawstring is folded to form two drawstring members, one drawstring member for each ribbon member, each drawstring member running freely through the apertures arranged lengthwise of a respective ribbon member.

4. The assembly as recited in claim 3, wherein the pairs of apertures on one of the ribbon members are in alignment with the pairs of apertures on the other of the ribbon members, and wherein each drawstring member is sequentially routed only through the pairs of apertures on the ribbon member associated with the respective drawstring member.

5. The assembly as recited in claim 3, wherein the pairs of apertures on one of the ribbon members are longitudinally displaced from the pairs of apertures on the other of the ribbon members, and wherein the drawstring members are sequentially routed from one pair of apertures on said other ribbon member to the displaced pair of apertures on said one ribbon member before being returned to the next pair of apertures on said other ribbon member.

6. The assembly as recited in claim 3, wherein the pairs of apertures on one of the ribbon members are in alignment with the pairs of apertures on the other of the ribbon members, and wherein the drawstring members are sequentially routed from one pair of apertures on said other ribbon member to the aligned pair of apertures on said one ribbon member before being returned to the next pair of apertures on said other ribbon member.

7. The assembly as recited in claim 1, wherein the ribbon is formed with a plurality of pairs of notches on opposite edges of the ribbon, one pair of notches at each bending zone, each pair of notches bounding a neck of reduced width as compared to the width of the ribbon, each neck being inclined along a respective bending axis.

8. The assembly as recited in claim 1, wherein the ribbon is formed with a plurality of cutouts each situated at, and elongated along, a respective bending axis.

9. The assembly as recited in claim 1, wherein each pair of apertures constitutes a pair of circular holes.

10. The assembly as recited in claim 1, wherein the ribbon has opposite end regions, and wherein the drawstring is connected to one end region of the ribbon and is pullable toward the other end region of the ribbon during forming of the bow.

* * * * *